US008605062B2

(12) United States Patent
Kohno et al.

(10) Patent No.: US 8,605,062 B2
(45) Date of Patent: Dec. 10, 2013

(54) DISPLAY DEVICE

(75) Inventors: Tohru Kohno, Kokubunji (JP); Mitsuhide Miyamoto, Kawasaki (JP); Hajime Akimoto, Kokubunji (JP); Naruhiko Kasai, Yokohama (JP); Masato Ishii, Tokyo (JP)

(73) Assignees: Japan Display Inc., Tokyo (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 1621 days.

(21) Appl. No.: 12/073,219

(22) Filed: Mar. 3, 2008

(65) Prior Publication Data

US 2008/0218499 A1 Sep. 11, 2008

(30) Foreign Application Priority Data

Mar. 9, 2007 (JP) ..... 2007-060390

(51) Int. Cl.
*G09G 3/30* (2006.01)

(52) U.S. Cl.
USPC ..... 345/204; 345/76

(58) Field of Classification Search
USPC ..... 345/76
See application file for complete search history.

(56) References Cited

U.S. PATENT DOCUMENTS

| | | | | |
|---|---|---|---|---|
| 8,294,644 | B2 * | 10/2012 | Marx et al. | 345/82 |
| 2005/0110720 | A1 * | 5/2005 | Akimoto et al. | 345/76 |
| 2005/0134541 | A1 * | 6/2005 | Jang et al. | 345/94 |
| 2005/0204219 | A1 * | 9/2005 | Taguchi et al. | 714/724 |
| 2006/0232541 | A1 * | 10/2006 | Kudo et al. | 345/98 |

FOREIGN PATENT DOCUMENTS

| | | |
|---|---|---|
| JP | 2002-341825 | 5/2001 |
| JP | 2005-156697 | 11/2003 |
| JP | 2007-041574 | 6/2006 |

* cited by examiner

*Primary Examiner* — Seokyun Moon
*Assistant Examiner* — Jose Soto Lopez
(74) *Attorney, Agent, or Firm* — Stites & Harbison PLLC; Juan Carlos A. Marquez, Esq.; Nicholas B. Trenkle

(57) ABSTRACT

To shorten the measuring time of the characteristics of light emission of OLED elements for feedback to image data for image display in an organic EL display device. Pixels that emit red lights, pixels that emit green lights, and pixels that emit blue lights are arranged on a screen in a matrix manner. A detection system is provided on the upper side of the screen. A detection line extending from the detection system is coupled to the respective pixels through analog switches and digital switches controlled by switch controlling lines. A detection scanning circuit is provided on the right side of the screen. Detection switch controlling lines extend from the detection scanning circuit. By appropriately selecting the analog switches, the switch controlling lines, and the detection switch controlling lines, the voltage-current characteristics of plural pixels are measured at the same time.

7 Claims, 14 Drawing Sheets

DISPLAY DEVICE

CLAIM OF PRIORITY

The present application claims priority from Japanese Application JP 2007-060390 filed on Mar. 9, 2007, the content of which is hereby incorporated by reference into this application.

BACKGROUND OF THE INVENTION

1. Field of the Invention

The present invention relates to a display device having a light-emitting element such as an organic EL, and particularly to a technique by which temporal changes in characteristics of light emission of an organic EL element are detected.

2. Description of the Related Art

Although the mainstream of a conventional display device was a CRT, a liquid crystal display device, a plasma display device, and the like that are flat display devices are put to practical use in place of a CRT, and the demand is on the rise. Further, in addition to these display devices, a display device (hereinbelow, referred to as an organic EL display device (OLED)) using organic electroluminescence and a display device (hereinbelow, referred to as an FED display device) in which electron sources using field emission are arranged in a matrix manner and fluorescent materials arranged at anodes are lit so as to form an image have been being developed and put to practical use.

The organic EL display device has the following characteristics: (1) a backlight is not necessary because the organic EL display device is of a light-emitting type as compared to a liquid crystal display; (2) a voltage required for light emission is as low as 10V or less, and power consumption can be possibly reduced; (3) a vacuum structure is not necessary, so that the organic EL display device can be suitably made lighter and thinner as compared to the plasma display device and the FED display device; (4) response time is as short as several micro seconds, and the characteristics of a moving picture are excellent, and (5) a view angle is as wide as 170 degrees or more.

Although the organic EL display device has the above-described characteristics, one of the problems is that there is a phenomenon that the characteristics of light emission of an organic light emitting diode element (hereinbelow, referred to as an OLED element) are changed along with the operation time. The temporal changes in characteristics of the OLED element differ depending on pixels. Accordingly, in order to correctly display an image, it is necessary to detect the changes in characteristics of the OLED element of each pixel and to feed back the result to a signal input from a host.

The changes in characteristics of the OLED element are present as changes in voltage-current characteristics of the OLED element. Specifically, even when a voltage is applied at the same level, a current to flow is decreased along with the operation time. This phenomenon is shown in FIG. 11. The horizontal axis of FIG. 11 represents a voltage applied to the OLED element, and the vertical axis thereof represents a current flowing into the OLED element. The characteristic 1 represents an initial characteristic of the OLED element. The characteristic 2 represents a characteristic of the OLED element after a certain period of time passed. Since it is conceivable that light emission of the OLED element is in proportion to a current flowing into the OLED element, even when a voltage is applied at the same level, the brightness of light emission of the OLED element is changed along with the passage of time, and thus an image can not be correctly displayed.

Conversely, this means that it is necessary to apply a higher voltage in order to flow a current at the same level so as to emit light at the same level. FIG. 12 shows changes in applied voltage in order to flow a current at the same level into the OLED element. In FIG. 12, the horizontal axis represents an operation time and the vertical axis represents an applied voltage for flowing a constant current into the OLED element. FIG. 12 shows that in order to flow a current at the same level to the OLED element, an applied voltage needs to be increased along with the operation time.

As described above, in order to correctly display an image in the organic EL display device, it is necessary to regularly measure the voltage-current characteristics of the OLED elements of the all pixels and to feed back the result to an input image signal. JP-A-2005-156697 and JP-A-2002-341825 describe such techniques.

In all of the above-described conventional techniques, the OLED elements of the all pixels are sequentially measured. In the case where the voltage-current characteristics of the OLED elements of the respective pixels are measured, it is necessary to charge floating capacitance due to presence of the floating capacitance in the respective pixels. Accordingly, it takes time to measure each pixel. In addition, when the screen of the display device becomes larger and the definition of the screen becomes higher, it takes a lot of time to measure the all pixels.

When the measuring time becomes longer, a period during which an image is displayed is limited. However, it is necessary to maintain the practical brightness of the display, so that a current at a higher level needs to flow into the OLED elements during the display period, and thus there arise various problems such as voltage drop at a power source line.

On the other hand, it is conceivable to increase a current at the time of measuring in order to shorten the measuring time. However, flowing of a current at a higher level results in increase in size of a circuit for measuring and in range of a voltage used. However, the increase of a current is not preferable because the increase in size of the measuring system leads to increase in cost of the display device by the amount of the increased size. Further, the increase of a current for measuring leads to consumption of a large electric power for measuring. Thus, the increase of a current is not preferable from this aspect.

SUMMARY OF THE INVENTION

The present invention is to solve the above-described problems, and an object of the present invention is to shorten the measuring time by measuring the voltage-current characteristics of plural OLED elements at a time without sequentially measuring those of the all OLED elements. Concrete means are described as follows.

(1) A display device in which pixels, each having a light-emitting element that emits a red light, a green light, or a blue light, are formed in a matrix manner, the device including: at least n signal lines for each color; a signal driving circuit which supplies an image signal to the signal lines; a display scanning circuit which supplies a signal for selecting pixels to which the image signal is transmitted; m scanning lines which extend from the display scanning circuit to intersect with the signal lines; a display unit which includes plural pixels coupled to the signal lines and the scanning lines; detection means which measures the characteristics of light emission of the red, green, or blue light-emitting elements of the respective pixels by flowing a constant current from the signal lines to the respective pixels; a detection scanning circuit which supplies, to the scanning lines, a signal for selecting pixels whose characteristics of light emission are measured; and m scanning lines which extend from the detection scanning circuit to intersect with the signal lines, wherein first switches coupled to the signal driving circuit and second switches coupled to the detection means are provided for the signal lines, plural second switches coupled to the detection means are selected at the same time, a group of two or more and less than m×n pixels are selected by supplying, from the detection scanning circuit, a signal for selecting plural pixels whose characteristics of light emission are measured, and plural pixels that emit the red, green, or blue lights are detected at the same time. The m and n are integral numbers of 2 or larger.

(2) The display device according to (1), wherein the characteristics of the light-emitting elements of the pixels are voltage-current characteristics of the pixels.

(3) The display device according to (1), wherein plural pixels detected at the same time are pixels which emit lights of the same color.

(4) The display device according to (1), wherein plural pixels detected at the same time are pixels arranged on the same line among the pixels arranged in a matrix manner.

(5) The display device according to (1), wherein plural pixels detected at the same time are pixels arranged on the same row among the pixels arranged in a matrix manner.

(6) The display device according to (1), wherein plural pixels detected at the same time include pixels which emit lights of different colors.

(7) The display device according to (1), wherein the light-emitting elements are organic light emitting diode (OLED) elements.

(8) The display device according to (1), wherein $X1 \leq X2$ is satisfied when X1 represents light-emitting efficiency of light-emitting elements in first pixels that emit lights of one of the red, green, and blue colors, and X2 represents light-emitting efficiency of light-emitting elements in second pixels that emit lights of the other colors, and $N1 \geq N2$ is satisfied when N1 represents the number of pixels in the case of detecting the characteristics of the light-emitting elements in the first pixels at the same time and N2 represents the number of pixels in the case of detecting the characteristics of the light-emitting elements in the second pixels at the same time.

(9) The display device according to (1), wherein $I1 \geq I2$ is satisfied when I1 represents a current value necessary when detecting the characteristics of the light-emitting elements in the first pixels that emit lights of one of the red, green, and blue colors at a constant voltage, and I2 represents a current value necessary when detecting the characteristics of the light-emitting elements in the second pixels that emit lights of the other colors at a voltage of the same level, and $n1 \geq n2$ is satisfied when n1 represents the number of pixels in the case of detecting the first pixels at the same time and n2 represents the number of pixels in the case of detecting the second pixels at the same time.

(10) The display device including a signal driving circuit unit which supplies an image signal, the display scanning circuit, the detection scanning circuit, and a detection unit which detects the characteristics of the light-emitting elements, according to (1), wherein there are provided switch means which control connection between a field effect transistor for driving the light-emitting elements and the detection unit on the basis of the image signal input to the pixels.

(11) The display device according to (10), wherein the field effect transistor and the switch means are provided on a transparent substrate by using a polycrystal Si-TFT (Thin-Film-Transistor).

(12) The display device according to (10), wherein the signal lines extend from the signal driving circuit unit, and detection lines having switches extend from the detection unit to be coupled to the signal lines, an image signal is supplied from the signal driving circuit unit to the signal lines when the switches are turned off, and a current from the detection unit is supplied to the signal lines when the switches are turned on.

By utilizing the present invention, it is possible to measure the light-emitting elements for feedback of temporal changes in characteristics of the light-emitting elements in a short time. The effects for each means are as follows.

According to the means (1), since plural light-emitting elements can be measured at a time in order to feed back the characteristics of light emission of the light-emitting elements to the image signal, it is possible to shorten the detection time and to frequently feed back the characteristics, thus realizing a correct tone display.

According to the means (2), since the voltage-current characteristics are measured as changes in characteristics of the light-emitting elements, it is possible to easily detect changes in characteristics of light emission.

According to the means (3), since plural pixels detected at the same time have the same color, it is possible to change the number of pixels detected at the same time and a current for measuring in accordance with characteristics of the light-emitting elements of each color.

According to the means (4), since plural pixels detected at the same time are arranged on the same line, plural pixels detected at the same time are positioned closer to each other, and thus it is possible to enhance the accuracy of the feedback.

According to the means (5), since plural pixels detected at the same time are arranged on the same row, plural pixels detected at the same time are positioned closer to each other, and thus it is possible to enhance the accuracy of the feedback.

According to the means (6), since plural pixels detected at the same time include pixels that emit lights of different colors, it is possible to measure changes in characteristics of the pixels of a combination of three R, G, and B colors at the same time for feedback.

According to the means (7), since plural OLED elements can be measured at a time in order to feed back the characteristics of light emission of the OLED elements to the image signal, it is possible to shorten the measuring time and to frequently feed back the characteristics, thus realizing a correct tone display.

According to the means (8), in the case of detecting plural light-emitting elements at the same time, the number of light-emitting elements with high light-emitting efficiency detected at the same time is decreased and the number of light-emitting elements with low light-emitting efficiency detected at the same time is increased. Accordingly, a current value to flow per pixel is decreased and the detection voltage is lowered, thus realizing a system with low electric power.

According to the means (9), in the case of detecting plural light-emitting elements at the same time, the number of light-emitting elements, detected at the same time, for which a current necessary for detection is large, is increased and the number of light-emitting elements, detected at the same time, for which a current necessary for detection is small is decreased. Accordingly, a current value to flow per pixel is decreased and the detection voltage is lowered, thus realizing a system with low electric power.

According to the means (10) to (12), since the TFT for controlling the input or output of a current for image formation and the TFT for detecting the characteristics of the OLED elements are provided, a current for image formation and a current for measuring the characteristics of the OLED elements can be allowed to flow into the OLED elements at different timings in one frame.

DETAILED DESCRIPTION OF THE PREFERRED EMBODIMENT

Detailed contents of the present invention will be disclosed in accordance with embodiments.

[First Embodiment]

Figure 1:
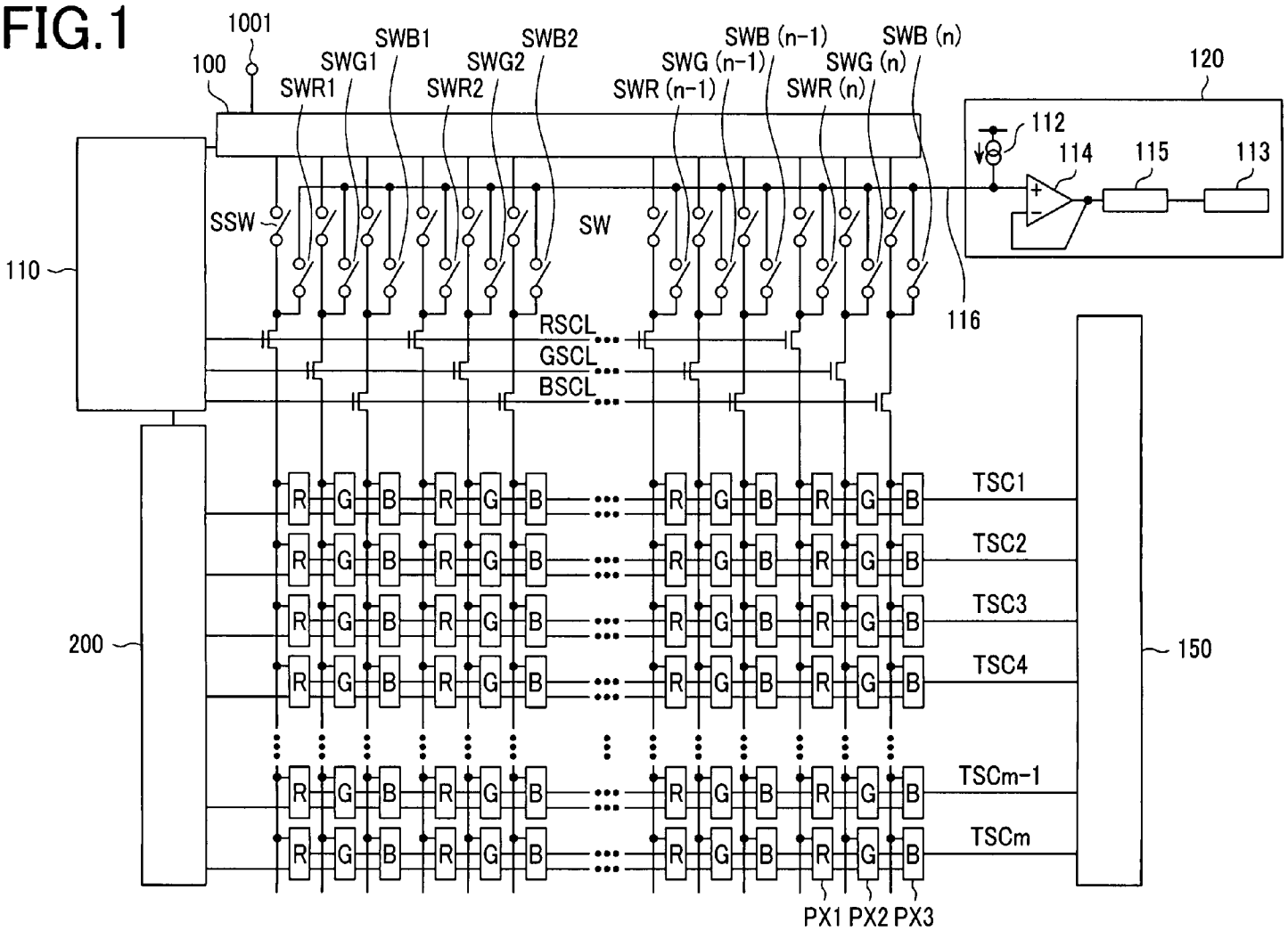
FIG. 1 is a circuit configuration of a display device according to a first embodiment.

FIG. 1 is a circuit diagram showing a display device of the present invention. On a screen, there are arranged pixels, each having an OLED element that emits a red light, a green right, or a blue light on the basis of an image signal, in a matrix manner. PX1 denotes a pixel that emits a red light, PX2 denotes a pixel that emits a green light, and PX3 denotes a pixel that emits a blue light. Specifically, pixels with the same color are arranged in the vertical direction, and a red pixel (R), a green pixel (G), and a blue pixel (B) are arranged in this order in the horizontal direction. On the screen, there are arranged n signal lines for each color, namely, 3n signal lines in total, in the horizontal direction, and there are arranged m scanning lines or detection switch controlling lines TSCs in the vertical direction.

On the left side of the screen, there is provided a display scanning circuit 200. Data writing into each pixel and light emission of each pixel are performed on a scanning-line basis, and the scanning lines extend from the display scanning circuit 200 in the screen direction. On the right side of the screen, there is arranged a detection scanning circuit 150. Detection of the characteristics of each pixel is performed on a scanning-line basis, independently from operations such as data writing into each pixel and light emission of each pixel. A detection operation is performed on a line basis of the screen. The detection switch controlling line TSC extends for each line from the detection scanning circuit 150 in the screen direction.

On the upper side of the screen, there is provided a signal driving circuit. An image signal is input to the signal driving circuit from a host through a signal input line. Image data that is serially transmitted from the host to the signal driving circuit are output to the screen for each line at a time. Signal lines through which image data is transmitted to the respective pixels extend from the signal driving circuit in the screen direction.

On the upper right side of the screen, there is provided a detection system 120. The detection system 120 includes a constant current source 112, a buffer amplifier 114, an analog-digital converter 115, and a memory 113. The constant current source 112 is used for measuring the voltage-current characteristics of each OLED element. The constant current source 112 supplies a current to each OLED element, and measures the voltage-current characteristic of each OLED element by measuring an anode potential of each OLED element. The buffer amplifier amplifies an anode voltage of each OLED element, and outputs the amplified anode voltage to the analog-digital converter 115. The analog-digital converter 115 converts the anode voltage of each OLED element from the buffer amplifier 114 into digital data, and inputs the digital data into the memory 113. The memory 113 stores the voltage-current characteristics of the all OLED elements. The voltage-current characteristics of the OLED elements stored in the memory 113 are fed back to the image data transmitted from the host so as to be supplied to each pixel as an image data signal.

A detection line 116 that extends from the detection system 120 is arranged in parallel to each signal line. A signal line analog switch SSW is arranged for each signal line, and a checking line analog switch is arranged for each checking line. Whether an image signal is supplied to the pixels or the voltage-current characteristics of the OLED elements are measured is determined by these analog switches. The checking lines are coupled to the signal lines via the respective analog switches. When the signal line analog switch SSW is turned on, the checking line analog switch is turned off, and image signal data is supplied to the pixels. In addition, when the checking line analog switch is turned on, the signal line analog switch SSW is turned off, and the voltage-current characteristics of the OLED elements can be detected.

Digital switches are provided between the respective signal lines and the pixels. The digital switches are provided for each color. An R switch, a G switch, and a B switch are provided for the red pixel, the green pixel, and the blue pixel, respectively. The R switch, the G switch, and the B switch are controlled by an R switch controlling line RSCL, a G switch controlling line GSCL, and a B switch controlling line BSCL, respectively. The R switch, the G switch, and the B switch are used for detecting the characteristics of the OLED elements for each color at a time, or for a single color.

Timing of supplying a scanning signal from the display scanning circuit 200 to the pixels, timing of supplying a data signal from the signal driving circuit to the pixels, and supplying of a detection signal from the detection scanning circuit 150 are controlled by a timing controller 110.

A period of one frame is divided into a display period and a blanking period in the present invention. The display period differs depending on display systems. In one of the systems, the display period is divided into a period during which image data is written into the respective pixels and a period during which the OLED elements are allowed to actually emit lights so as to display an image. In the other of the systems, the OLED elements are allowed to emit lights immediately after image data is written into the pixels. The present invention can be implemented in both of the systems.

The blanking period is a period during which neither writing of image data nor image display is performed. By utilizing the blanking period, changes in characteristics of the OLED elements are detected. Since the blanking period is a period during which neither writing of image data nor image display is performed, it is impossible to set the period longer. Accordingly, it is difficult to detect the characteristics of the all OLED elements during the blanking period in one frame. In this case, the characteristics of the all OLED elements are detected in plural different frames. However, if it takes a long time to detect the characteristics, measuring of the all OLED elements requires the large number of frames, and thus feedback can not be performed in real time. Accordingly, it is necessary to perform the detection of the characteristics of the OLED elements in a short time. In order to shorten the measuring time of each OLED element, it is conceivable, for example, to increase a current for checking that flows from the constant current source 112 of the detection system 120. However, this means an increase in size of a checking circuit, thus increasing the cost of the display device. Further, if a current for checking is increased, an electric power for checking is accordingly increased. Also from this aspect, the increase of a current results in a problem.

In the present invention, the measuring of the OLED elements is not performed for each OLED element, but the measuring of the characteristics of plural OLED elements is performed all together so as to shorten the measuring time, thus realizing appropriate feedback of the characteristics of the OLED elements. In general, human eyes are unable to recognize the pixels of the display device one by one. Accordingly, if the characteristics of the OLED elements are fed back to an image signal as feedback data obtained by measuring plural OLED elements all together, no problem practically occurs in many cases. The present invention is based on such knowledge.

Figure 2:
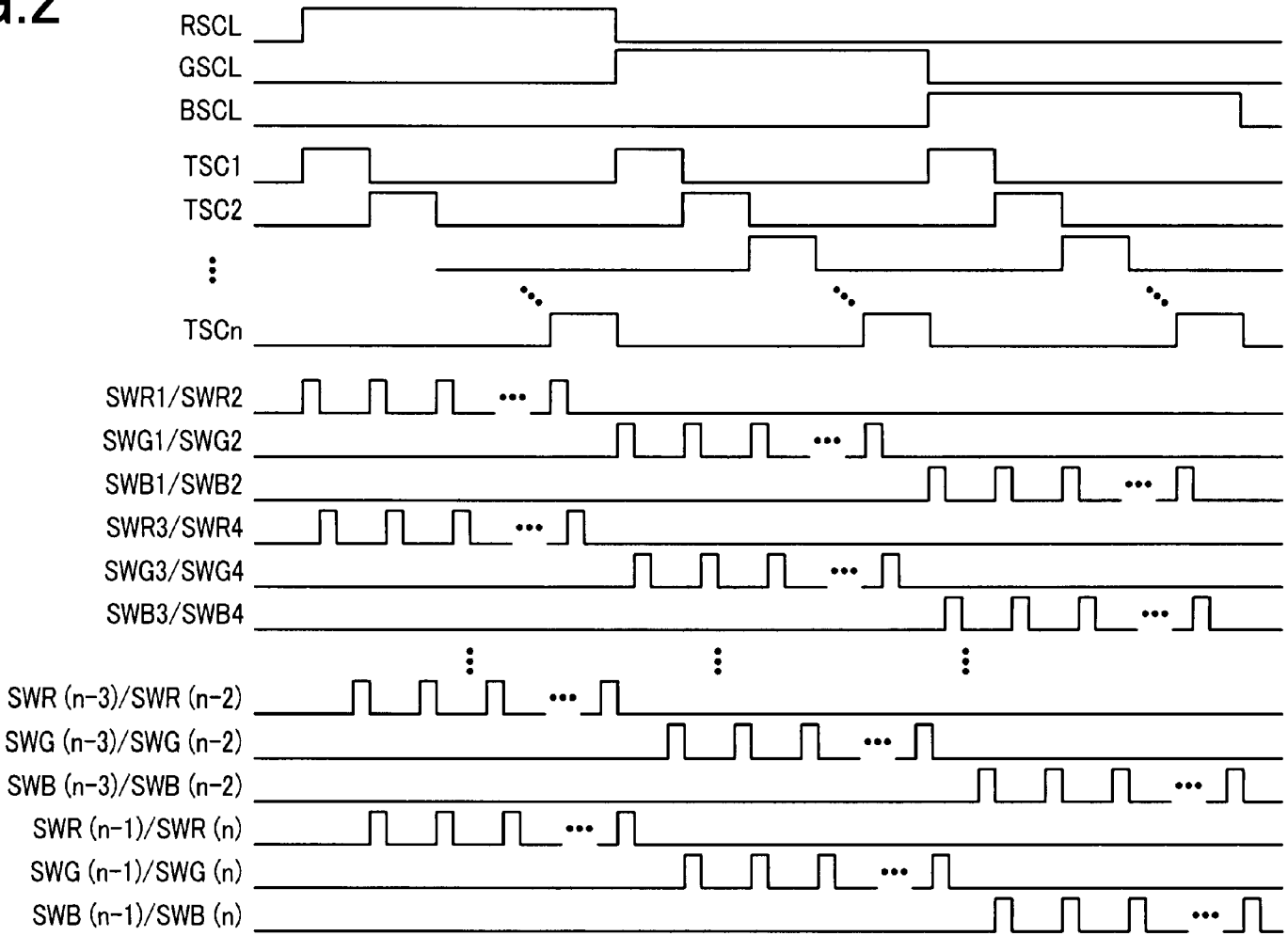
FIG. 2 is a timing chart showing an operation according to the first embodiment.

FIG. 2 is a timing chart showing an operation in the case of detecting the characteristics of the OLED elements in the circuit shown in FIG. 1. When detecting the characteristics of the OLED elements, the signal line analog switches SSWs are turned off. In this state, an ON-signal is transmitted to the R switch controlling line RSCL, and the R switch is turned on, so that the characteristics of the R OLED elements can be measured. Next, when an ON-signal is transmitted from the detection scanning circuit 150 to the detection switch controlling line TSC1, the R pixels on the first line of the screen are selected. In this state, the checking line analog switches are turned on, two by two at a time. Specifically, the switches are turned on, two by two at a time, such as SWR1/SWR2 and SWR3/SWR4, as shown in FIG. 2. When finishing the detection of n OLED elements in the horizontal direction, namely, when finishing the detection of the OLED elements n/2 times, an ON-signal is supplied to the detection switch controlling line TSC2, and the measuring of the R pixels on the second line is similarly performed. This operation is repeated to the m-th line at the lowermost of the screen, so that the measuring of the all R pixels is completed.

When the measuring of the OLED elements of the all R pixels is finished, the measuring of the OLED elements of the G pixels is performed. Specifically, the R switch is turned off, and the G switch is turned on through the G switch controlling line GSCL. Accordingly, the G pixels are selected. Thereafter, the detection switch controlling line TSC1 is turned on, so that the G pixels on the first line are ready to be selected. In this state, the switches are turned on, two by two at a time, such as SWG1/SWG2 and SWG3/SWG4, as shown in FIG. 2. When finishing the detection of n OLED elements in the horizontal direction, namely, when finishing the detection of the OLED elements n/2 times, an ON-signal is supplied to the detection switch controlling line TSC2, the measuring of the G pixels on the second line is similarly performed. This operation is repeated to the m-th line at the lowermost of the screen, so that the measuring of the all G pixels is completed. The measuring of the B pixels is the same as the above-described operation.

As described above, according to the first embodiment, since the pixels that are continuously arranged in the horizontal direction are measured two by two, the measuring time can be shortened to half that of the conventional technique. Although two pixels that are continuously arranged in the horizontal direction are measured in the description of the first embodiment, two pixels are not necessarily arranged in a continuous manner, but may be arranged in a dispersed manner. That is, the first and third pixels from the left may be measured first, and then the second and fourth pixels may be measured. Further, the number of pixels measured at the same time is not limited to 2, but may be 3 or more.

It is true that the measuring of, for example, two pixels at a time requires an increased capacity of the constant current source 112. However, it is not necessarily true that the capacity of the constant current source 112 needs to be increased to twice due to floating capacitance common to two pixels. Even in the case of measuring three or more pixels at a time, the same concept can be applied.

[Second Embodiment]

Figure 3:
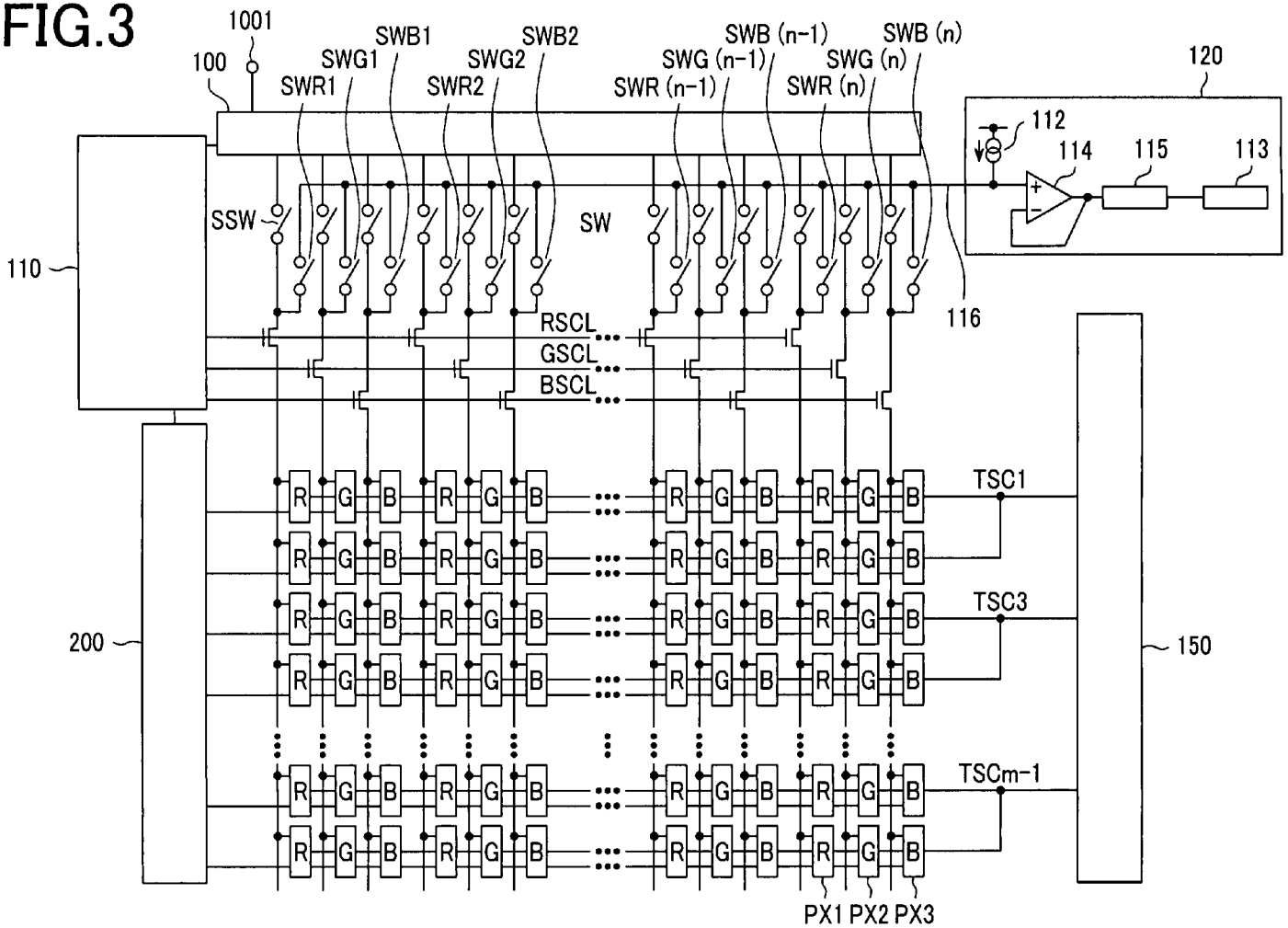
FIG. 3 is a circuit configuration of a display device according to a second embodiment.

FIG. 3 is a circuit diagram of a display device showing a second embodiment of the present invention. A difference between the second embodiment and the first embodiment is that each of the detection switch controlling lines TSCs extending from the detection scanning circuit 150 is mutually coupled to the pixels of two lines. The other configuration is the same as FIG. 1 of the first embodiment.

Figure 4:
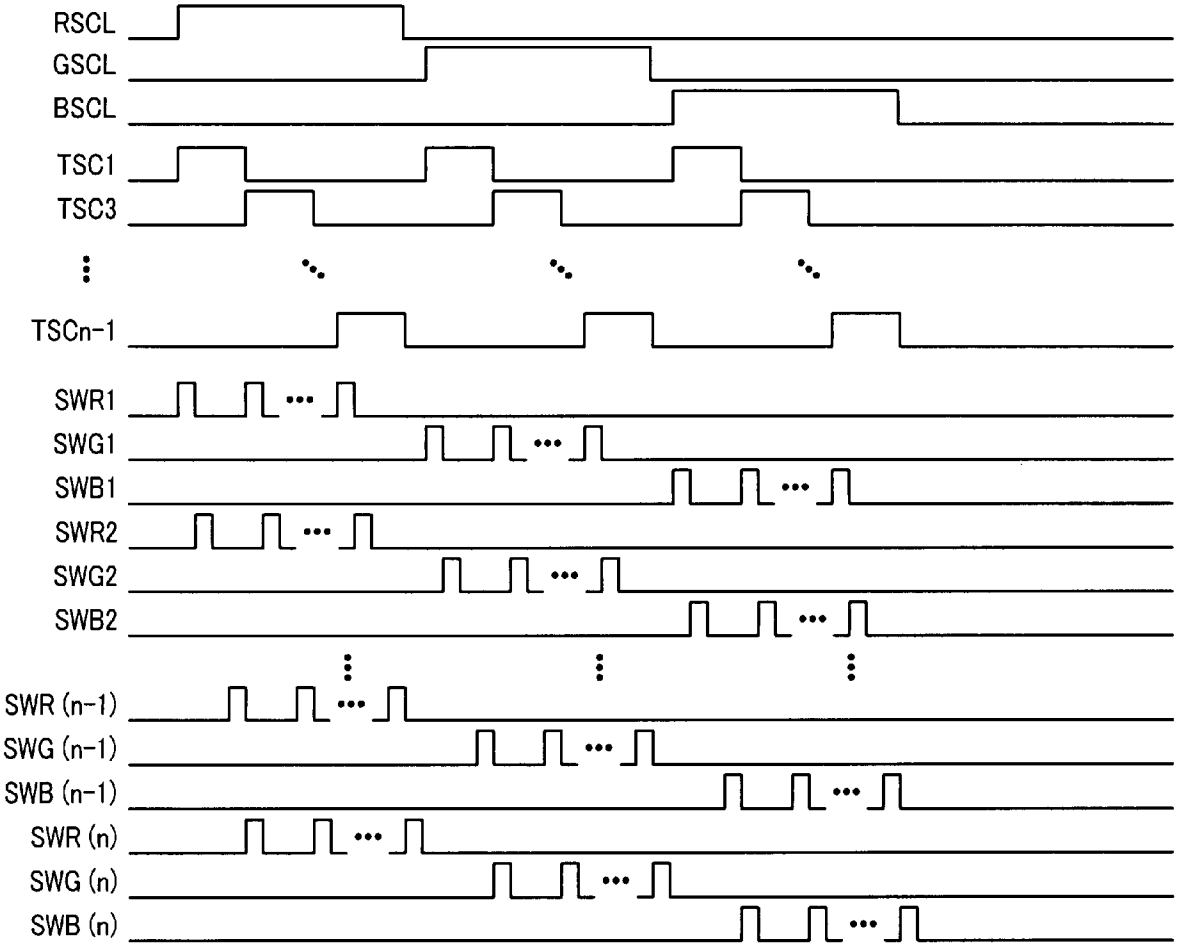
FIG. 4 is a timing chart showing an operation according to the second embodiment.

FIG. 4 is a timing chart showing an operation in the case of detecting the characteristics of the respective OLED elements in the circuit shown in FIG. 3. When detecting the characteristics of the OLED elements, the signal line analog switches SSWs are turned off, as similar to the first embodiment. In this state, an ON-signal is transmitted to the R switch controlling line RSCL, and the R switch is turned on, so that the characteristics of the R OLED elements can be measured. Next, when an ON-signal is transmitted from the detection scanning circuit 150 to the detection switch controlling line TSC1, the R pixels on the first and second lines of the screen are selected. In this state, when the checking line analog switches are sequentially turned on from the left side of the screen, the R pixels on the first and second lines are checked at a time. When the checking is performed n times in the horizontal direction in such a manner, the characteristics of the OLED elements of 2n R pixels on the first and second lines can be measured.

Thereafter, when an ON-signal is transmitted from the detection scanning circuit 150 to the detection switch controlling line TSC3, the R pixels on the third and fourth lines of the screen are selected. Then, the detection operation of the respective OLED elements is similarly performed. Such an operation is repeated m/2 times, so that the measuring of the characteristics of the OLED elements of the all R pixels is completed.

When finishing the measuring of the OLED elements of the R pixels, the measuring of the OLED elements of the G pixels is performed. Specifically, the R switch is turned off, and the G switch is turned on through the G switch controlling line GSCL. Accordingly, the G pixels are selected. The measuring of the OLED elements of the G pixels is the same as the detection of the OLED elements of the R pixels. The detection of the OLED elements of the B pixels is also the same.

According to the second embodiment, since the characteristics of the OLED elements of two pixels that are continuously arranged in the vertical direction are measured at the same time, the measuring time required for the all pixels can be shortened to half that of the conventional technique. Although two pixels that are continuously arranged in the vertical direction are measured in the description of the second embodiment, two pixels are not necessarily arranged in a continuous manner, but may be arranged in a dispersed manner. That is, the pixels on the first and third lines from the above may be measured first, and then the pixels on the second and fourth lines may be measured. Further, the number of pixels measured at the same time is not limited to 2, but may be 3 or more.

[Third Embodiment]

Figure 5:
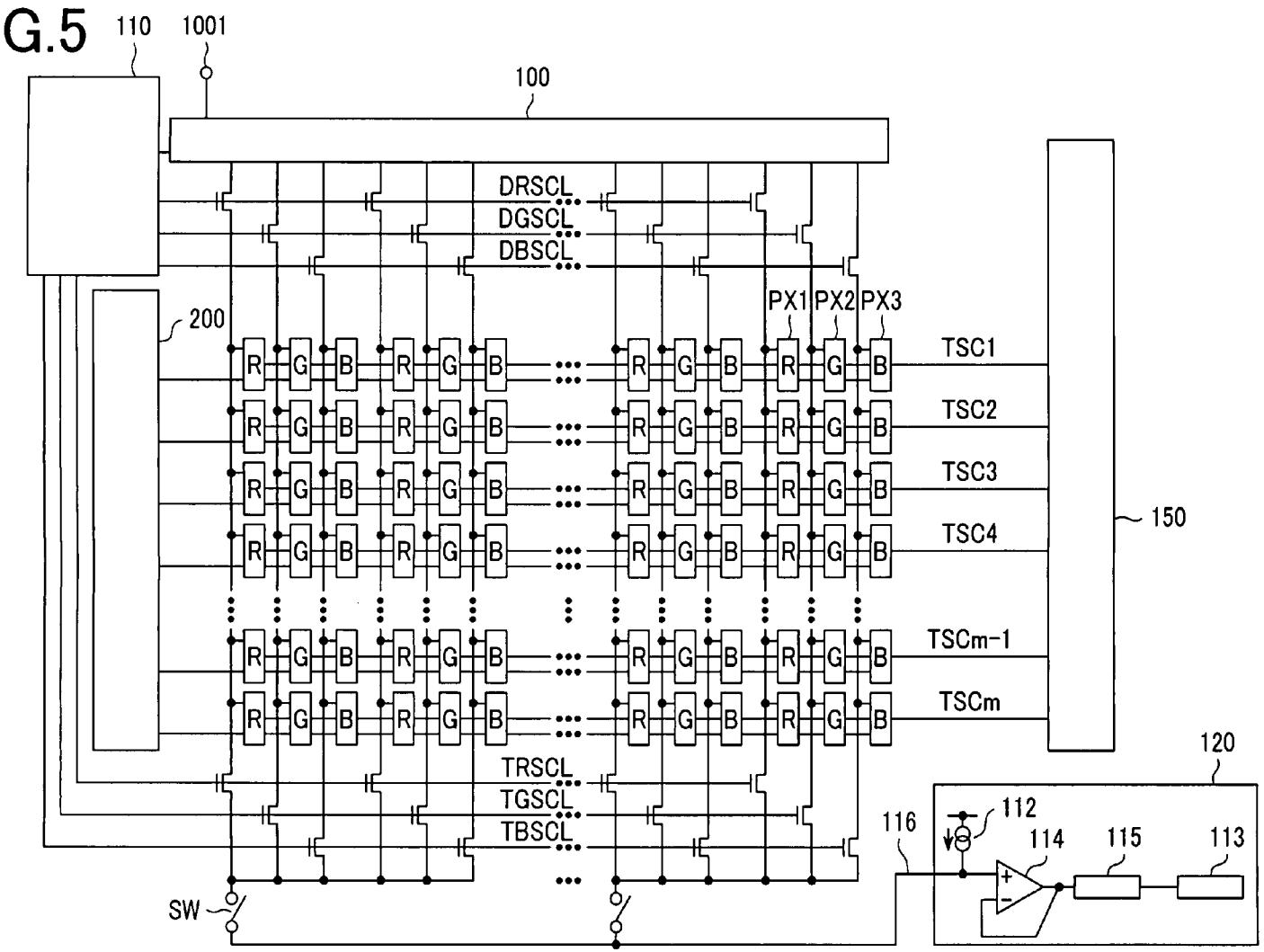
FIG. 5 is a circuit configuration of a display device according to a third embodiment.

FIG. 5 is a circuit diagram of a display device showing a third embodiment of the present invention. A characteristic of the third embodiment shown in FIG. 5 is that the detection system 120 and the group of detection switches are arranged on the lower side opposite to the signal driving circuit. In FIG. 5, the detection system 120 is arranged on the lower right side of the screen. The configuration of the detection system 120 is the same as those in the first and second embodiments.

As shown in FIG. 5, by arranging the detection system 120 and the group of detection switches on the lower side of the screen, it is not necessary to provide plural analog switches as in the first and second embodiments. FIG. 5 is an example in which the R, G, and B pixels are detected for each color on a two-by-two basis at a time. In a state where the checking analog switches are turned on, an image is not displayed, and the measuring of the characteristics of the OLED elements of the respective pixels is performed. At this time, a display R switch controlled by a display R switch controlling line DRSCL, a display G switch controlled by a display G switch controlling line DGSCL, and a display B switch controlled by a display B switch controlling line DBSCL in FIG. 5 are turned off. A detection R switch controlled by a detection R switch controlling line TRSCL, a detection G switch controlled by a detection G switch controlling line TGSCL, and a detection B switch controlled by a detection B switch controlling line TBSCL are turned on. On the other hand, an image is displayed in a state where all the detection line analog switches SWs are turned off.

In the third embodiment, an arbitrary number of pixels can be detected at a time by bundling the lines together. Although six pixels are detected at a time in the third embodiment, the number of pixels is not limited to 6, but the number of pixels detected at a time may be increased or decreased in accordance with the size of the detection system 120. Further, it is not necessary to detect the pixels at different timings for each color in the third embodiment, but the pixels of the respective colors can be measured at the same time.

The detection method in the third embodiment is the same as those in the first and second embodiments. The display R switch, the display G switch and the display B switch are turned off, and a detection operation is accordingly ready to be performed. By turning on the detection switch controlling line TSC1, the detection of the characteristics of the pixels on the first line is performed. When the detection R switch, the detection G switch, and the detection B switch are turned on, and the detection line analog switch SWR1 is closed, the characteristics of the OLED elements for six pixels can be detected. In accordance with an on-state or off-state of the detection R switch, the detection G switch, and the detection B switch and bundling manners of the respective checking lines, the kinds or number of colors of the OLED elements to be detected at a time can be arbitrarily selected. When finishing the detection of the pixels on the first line in such a manner, the detection switch controlling line TSC2 is selected, and an operation of detecting the pixels on the second line is performed. This operation is repeated to the m-th line, so that the measuring of the all pixels is completed.

As described above, according to the third embodiment, since the detection system 120 and the group of detection switches are arranged on the lower side of the screen opposite to the signal driving circuit, plural analog switches can be omitted, and it is possible to increase the degree of freedom of the number of and a combination of pixels to be detected at the same time in the detection operation.

[Fourth Embodiment]

Figure 6:
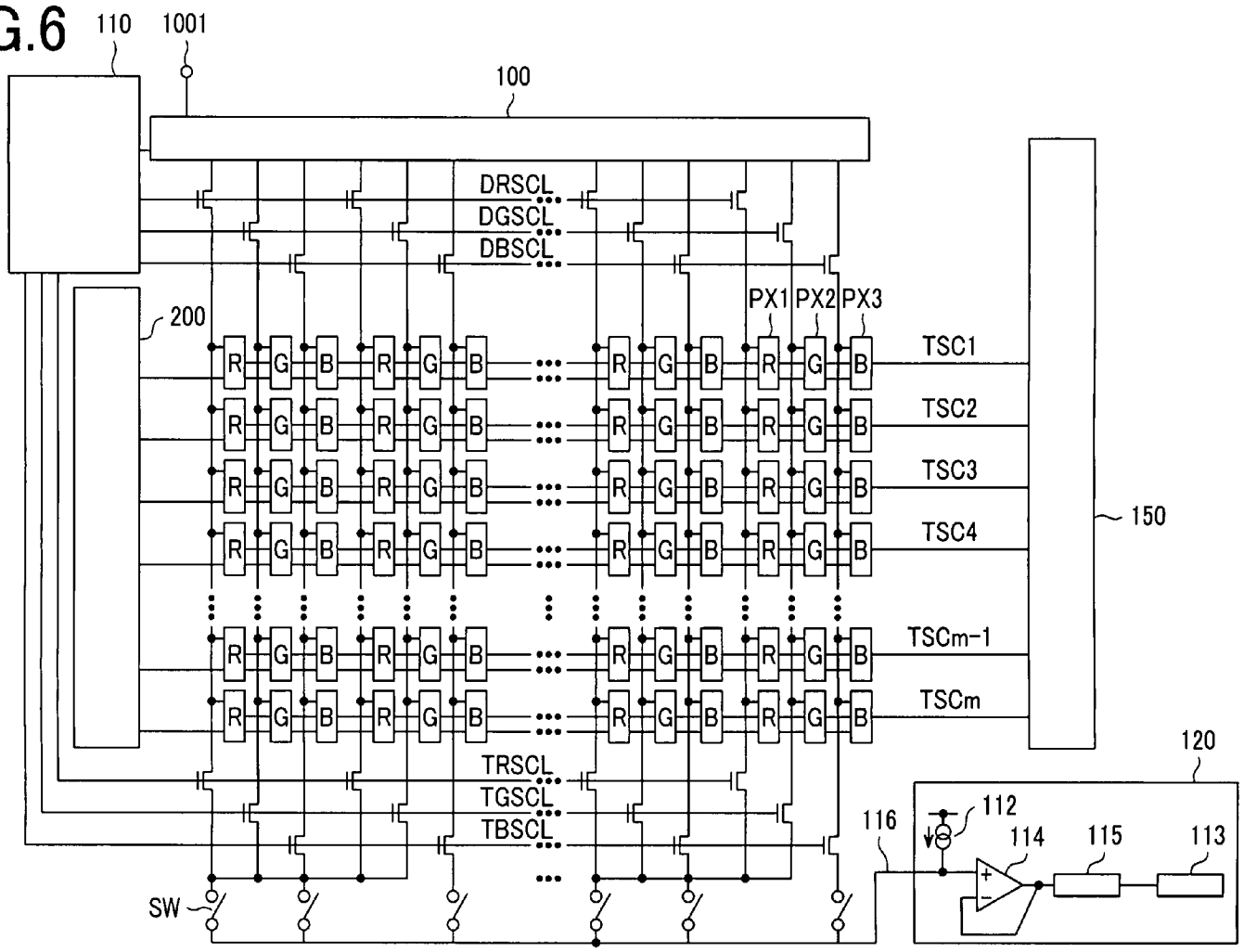
FIG. 6 is a circuit configuration of a display device according to a fourth embodiment.

FIG. 6 is a fourth embodiment of the present invention. In the fourth embodiment, the detection system 120 and the group of detection switches are arranged on the lower side of the screen opposite to the signal driving circuit, as similar to the third embodiment. Where FIG. 6 largely differs from FIG. 5 is that the number of OLED elements measured at a time differs depending on the colors.

The OLED elements differ in light-emitting efficiency depending on the colors. Specifically, even if a current is allowed to flow at the same level, the light-emitting intensity differs depending on the colors. For example, in the case where the output voltage of the buffer amplifier 114 is uniformed to a constant voltage when the blue OLED elements are the lowest in light-emitting efficiency, a current value necessary for detecting the characteristics of the blue OLED elements is higher than that necessary for detecting the characteristics of the OLED elements of the other colors. Thus, when the value of the current source is made constant, the number of OLED elements that can be detected at a time differs depending on the colors. If the number of blue OLED elements that can be detected at a time is made smaller than that of the OLED elements of the other colors, a range of the output voltage is uniformed while the size of the constant current source 112 is constant.

FIG. 6 shows a case in which two each of the red and green OLED elements are detected at a time, and the blue OLED elements are detected one by one. It is assumed in the example of the display device that a current twice as high as that for the red or green OLED elements needs to flow into the blue OLED elements. In this case, the constant current source 112 having a current higher than a constant value is necessary for the blue OLED elements, irrespective of whether the red or green OLED elements are detected on a plural basis at a time. Thus, according to the fourth embodiment, by detecting two each of the red and green OLED elements at a time, the detecting time can be shortened without changing the size of the detection system 120.

In addition, it is possible that two each of the red and green OLED elements, namely, four are detected at a time, and the blue OLED elements are detected one by one. In this case, a current four times as high as that for the red or green OLED elements needs to flow into the blue OLED elements.

In the above-described example, a combination of one blue OLED element and two red or green OLED elements has been described. However, the combination is not limited to the above, but may be variously changed in the fifth embodiment. For example, when the red OLED elements are different in light-emitting characteristics from the green OLED elements, the number of all the red, green, and blue OLED elements detected at a time can be changed. Then, the number of OLED elements detected at a time may be changed in accordance with the light-emitting efficiency of the OLED elements. Specifically, in the case where X1≤X2 (the light-emitting efficiency of the OLED elements is represented as X1 and the light-emitting efficiency of OLED elements 2 is represented as X2) is satisfied, if N1≤N2 (the number of OLED elements detected at a time is represented as N1 and the number of OLED elements 2 detected at a time is represented as N2) is satisfied, the detecting speed becomes faster because the detection is performed based on the OLED elements for which a large amount of current is necessary. In addition, if N1≥N2 is satisfied, the amount of current distributed per one pixel is decreased. Thus, although the detecting speed becomes slower than that in the case of N1≥N2, the OLED elements are detected at a low voltage, thus leading to low electric power of neighboring measuring systems. Further, in order to uniform the output of the buffer amplifier 114 to a certain constant voltage in the detection, in the case where Y1≥Y2 (a current for the OLED elements at a certain voltage is represented as Y1 and a current for the OLED elements 2 is represented as Y2) is satisfied, if M2≥M1 (the number of OLED elements detected at a time is represented as M1 and the number of OLED elements 2 detected at a time is represented as M2) is satisfied, the detection speed is given a priority because the detection is performed based on the OLED elements for which a large amount of detection current per one pixel is necessary. If M1≥M2 is satisfied, the detection voltage is lowered, and thus the lower electric power of the detection systems is given a priority.

An operation of detecting the respective OLED elements in the fourth embodiment is the same as that in the third embodiment. As described above, according to the fourth embodiment, the OLED elements can be detected at a time without increasing the circuit size of the detection system 120. Accordingly, it is possible to rapidly detect the characteristics of the OLED elements while suppressing the rise of the cost of the display device.

[Fifth Embodiment]

Figure 7:
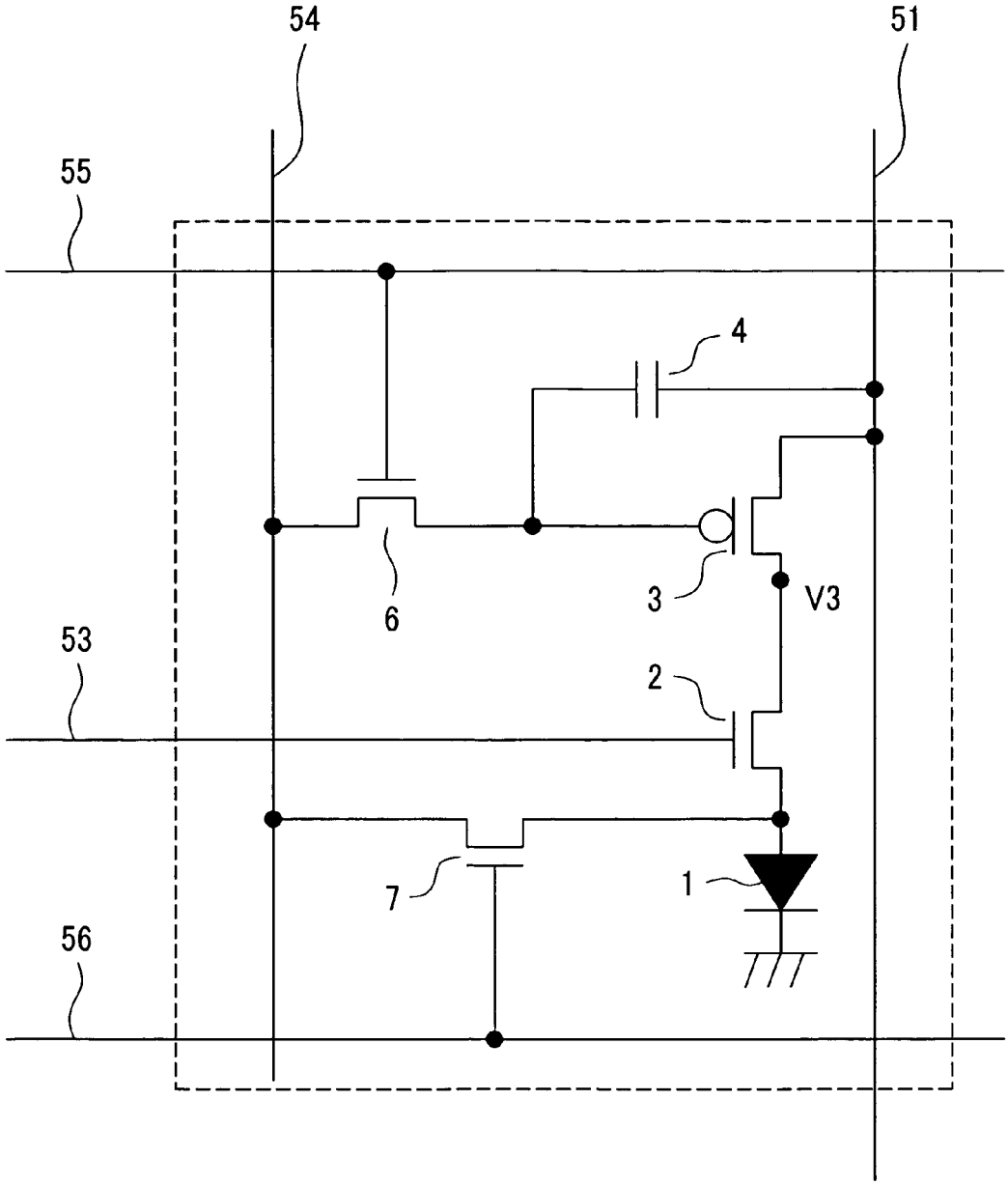
FIG. 7 is a circuit configuration of a pixel portion according to a fifth embodiment.

FIG. 7 is an example of a pixel configuration in which the present invention is implemented. In FIG. 7, an OLED driving TFT3, a lighting TFT switch 2, and an OLED element 1 are coupled to each other in series between a power source line 51 and a reference potential. The reference potential is a potential that serves as a reference for the display device, and is a wide concept including a ground. The lighting TFT switch 2 is a switch for determining whether or not the OLED element 1 is allowed to emit a light. The OLED driving TFT3 is a TFT that controls the tone of light emission of the OLED element 1 in accordance with an image signal. In the fifth embodiment, the OLED driving TFT3 is configured by a P-type TFT. In this specification, a carrier of a transistor serves as a hole in the P-type TFT and a carrier of a transistor serves as an electron in an N-type TFT.

In FIG. 7, when a select line is selected, a select switch 6 is turned on, and image signal data from a signal line 54 is input. The image signal data is stored in a retentive capacitance 4. After the image signal data is written into the retentive capacitance 4, when the select switch 6 is closed, a charge in accordance with the image signal data is stored in the retentive capacitance 4, and a gate potential of the OLED driving TFT3 is retained. When the lighting switch is turned on in this state, a current flows into the OLED element 1 in accordance with the gate potential of the OLED driving TFT3 to form an image.

In the fifth embodiment, a detection switch 7 is coupled between the lighting TFT switch 2 and the OLED element 1, and the detection switch 7 is controlled by the detection switch controlling line TSC 56 extending from the detection scanning circuit 150. Specifically, the lighting TFT switch 2 is turned off for a certain period of time in one frame, so that light emission of the OLED element 1 for image formation is stopped. During this period, the detection switch 7 is turned on, and a current from the constant current source 112 of the detection system 120 is allowed to flow into the OLED element 1, so that the detection of the characteristics of the OLED element 1 is performed.

Figure 8:
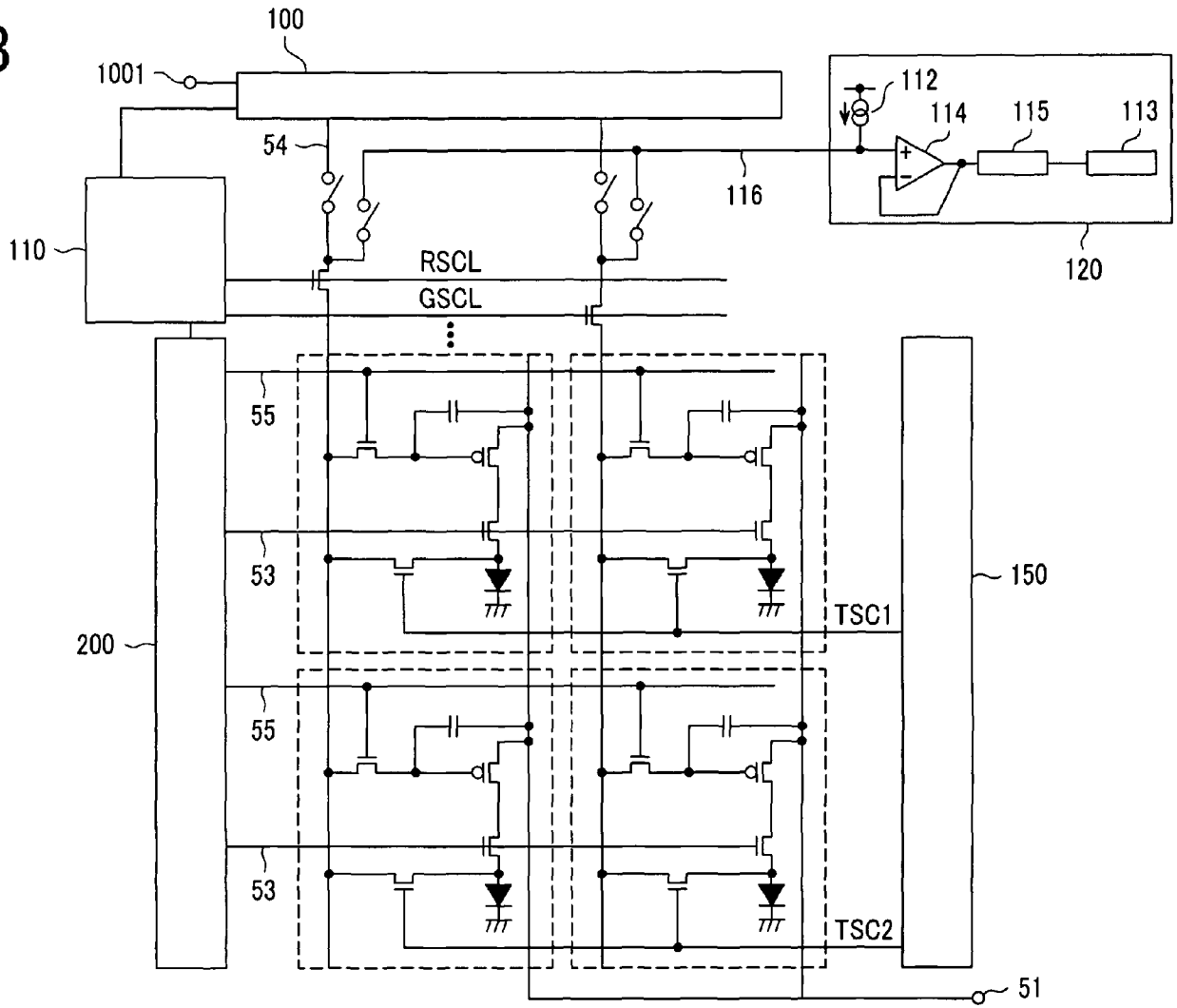
FIG. 8 is a circuit configuration of a display device using the pixel in FIG. 7.

FIG. 8 is an example in which the pixel structure shown in FIG. 7 is applied to the display device in FIG. 1. Although the screen is composed of plural pixels, only four pixels are displayed in FIG. 8. In FIG. 8, the display scanning circuit 200 is provided on the left side of the screen. Select switch lines 55 and lighting switch lines 53 extend from the display scanning circuit 200 to the respective pixels. Image signal data can be written for each line of the screen through the select switch lines 55. The lighting switch lines 53 are coupled to gates of the lighting TFT switches 2 of the respective pixels, so as to control whether or not the OLED element 1 is lit on. The detection scanning circuit 150 is provided on the right side of the screen. The detection switch controlling lines TSCs extend from the detection scanning circuit 150 so as to control the detection switches 7. When the detection switches 7 are turned on, the voltage-current characteristics of the OLED element 1 can be detected. When the detection switches 7 are turned on, the lighting TFT switches 2 are turned off.

The signal driving circuit is provided on the upper side of the screen. The signal lines 54 extend from the signal driving circuit to the respective pixels. The R switches, G switches, or B switches configured by the signal line analog switches SSWs and MOSs are provided for the signal lines 54. The signal lines 54 are coupled to sources of the select switches 6 and sources of the detection switches 7 of the respective pixels.

The detection system 120 is provided on the right upper side of the screen. The detection system 120 is configured as described in FIG. 1. A detection line 116 extends from the detection system 120, and is branched so as to be coupled to the respective signal lines 54 in parallel. The branched detection lines 116 are coupled to the signal lines 54 via the detection line analog switch SWR1 and the like. When the signal line analog switch SSW is turned on, an image is displayed. When the detection line analog switch SWR1 and the like are turned on, the detection of the characteristics of the respective OLED elements 1 is performed.

All of the R switches, G switches and the like which are provided for the signal lines 54 and are MOS switches are usually turned on when an image is displayed. In the case where the OLED elements 1 are checked for each color when the detection of the characteristics of the OLED elements 1 is performed, the MOS switches corresponding to the pixels of the respective colors are turned on, and the other MOS switches are turned off.

As described above, the detection switches 7 are provided for the respective pixels, and the detection switch controlling lines TSCs extending from the detection scanning circuit 150 are coupled to the gates of the detection switches 7 in the fifth embodiment. Accordingly, the detection of the characteristics of the respective OLED elements 1 is controlled by a signal from the detection scanning circuit 150. In the above-described example, there has been described a case in which the pixel shown in FIG. 7 is applied to the display device in FIG.

1. However, it is obvious that the pixel configuration in FIG. 7 can be applied to not only the display device in FIG. 1, but also the display devices in FIGS. 3, 5, 6, and the like.

[Sixth Embodiment]

Figure 9:
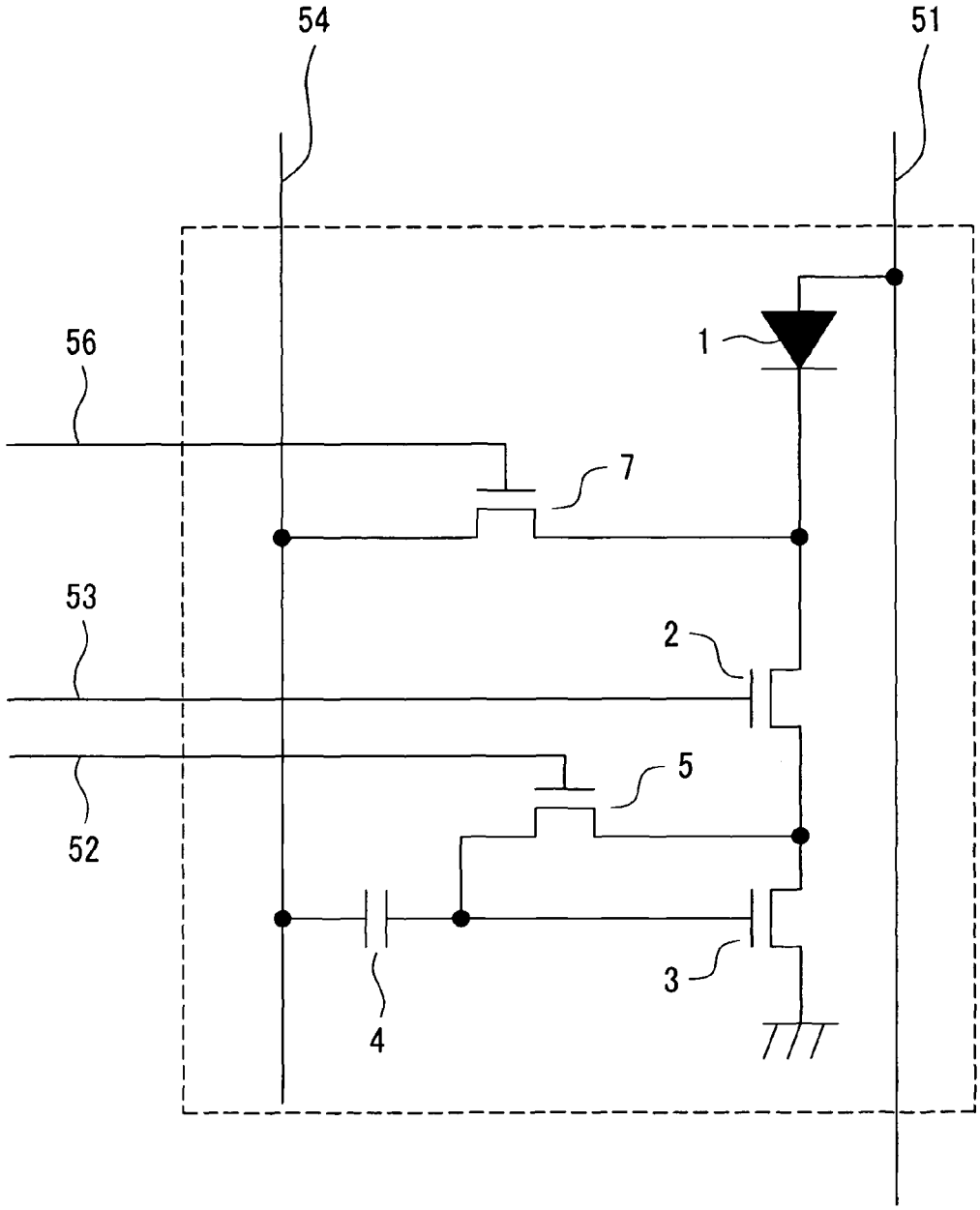
FIG. 9 is a circuit configuration of a pixel portion according to a sixth embodiment.

FIG. 9 is another example of the pixel configuration in which the present invention is implemented. In the pixel configuration used in the fifth embodiment, the OLED driving TFT 3 controls the tone of the OLED element 1. The tone display is performed in such a manner that the gate potential of the OLED driving TFT3 is retained by the charge retained by the retentive capacitance 4. However, due to variations of the TFTs in threshold voltage VTH depending on manufacturing processes, there is a problem that the gate potential of the OLED driving TFT3 is affected by the variations in the threshold voltage VTH and correct tone display can not be performed. The pixel circuit in FIG. 9 is configured as countermeasures against the problem.

In FIG. 9, the OLED element 1, the lighting TFT switch 2, and the OLED driving TFT3 are coupled to each other in series between the power source line 51 and the reference potential. The lighting TFT switch 2 is a switch for determining whether or not the OLED element 1 is allowed to emit a light. The OLED driving TFT3 is a TFT that controls the tone of light emission of the OLED element 1 in accordance with an image signal. In the sixth embodiment, the OLED driving TFT3 is configured by an N-type TFT. Accordingly, all the pixel portions can be advantageously manufactured by N-type processes in the sixth embodiment.

The pixels are used for a display device of a type which is driven by dividing a display period in one frame into a period during which data is written and a period during which an image is actually displayed. In FIG. 9, when a reset TFT switch 5 is turned on in a state where the lighting TFT switch 2 is turned off, image signal data is written into the retentive capacitance 4 through the signal line 54. When the lighting TFT switch 2 is turned on for a short period of time while the reset TFT switch 5 is turned on after the image data is written, a current flows into the OLED driving TFT3. This state is regarded as a state in which the OLED element 1 and the OLED driving TFT3 form an inverter. The gate and source of the OLED driving TFT3 are shorted by the reset TFT switch 5. Accordingly, the gate potential of the OLED driving TFT3 is set at a point, on a characteristic curved-line that determines the relation between the gate and the source of the OLED driving TFT3, where the source of the OLED driving TFT3 is equal to the gate thereof in potential. The gate potential of the OLED driving TFT3 in this case is uniquely determined by the threshold voltage VTH of the OLED driving TFT3. Since a signal voltage in accordance with the gate potential is written, effects caused due to the variations in the threshold voltage VTH of the OLED driving TFT3 can be eliminated. Thereafter, when the reset TFT switch 5 and then the lighting TFT switch 2 are turned off, a charge that correctly reflects the signal voltage is maintained at the retentive capacitance 4. It should be noted that the following driving method is used for an organic EL display device for which the pixel shown in FIG. 9 is used. Specifically, one frame is divided into a period during which a data signal is written and a period during which light is emitted. In the data-writing period, an image signal is written into the all pixels by the above-described manner. Thereafter, a current is allowed to flow into the OLED elements 1 by closing the lighting TFT switches 2 for the all pixels, so that an image is formed. Specifically, the first half of one frame is virtually displayed in black and an image is formed in the last half of one frame.

In the sixth embodiment, the detection switch 7 is coupled between the lighting TFT switch 2 and a cathode of the OLED element 1, and the detection switch 7 is controlled by the detection switch controlling line TSC extending from the detection scanning circuit 150. Specifically, the lighting TFT switch 2 is turned off for a certain period of time in one frame, so that light emission of the OLED element 1 for image formation is stopped. During this period, the detection switch 7 is turned on, and a current from the constant current source 112 of the detection system 120 is allowed to flow into the OLED element 1, so that the detection of the characteristics of the OLED element 1 is performed.

Figure 10:
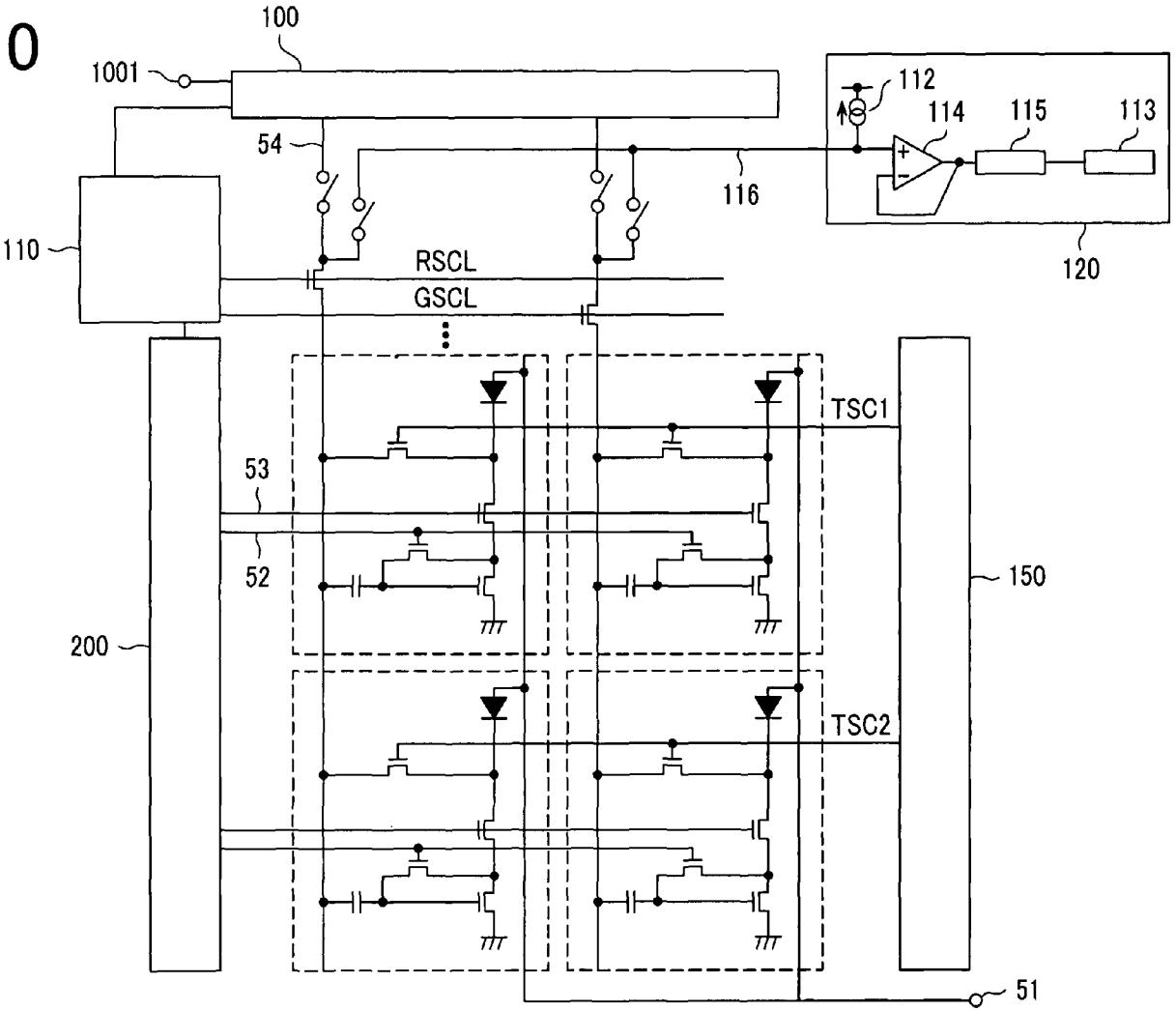
FIG. 10 is a circuit configuration of a display device using the pixel in FIG. 9.
Figure 11:
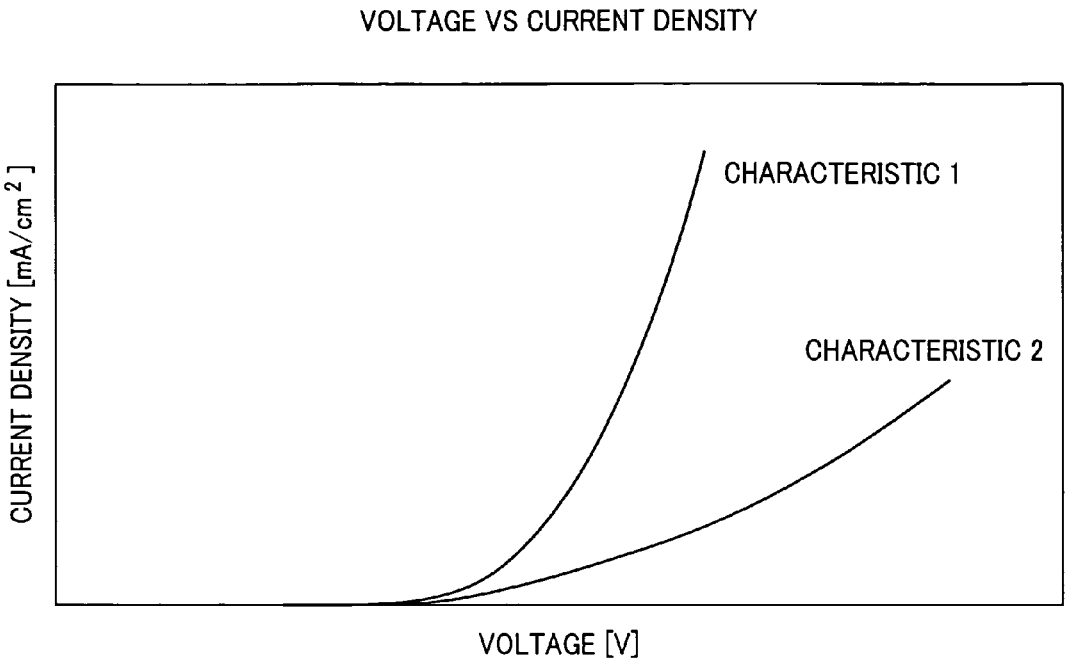
FIG. 11 is an example of temporal changes in voltage-current characteristics of OLED elements.
Figure 12:
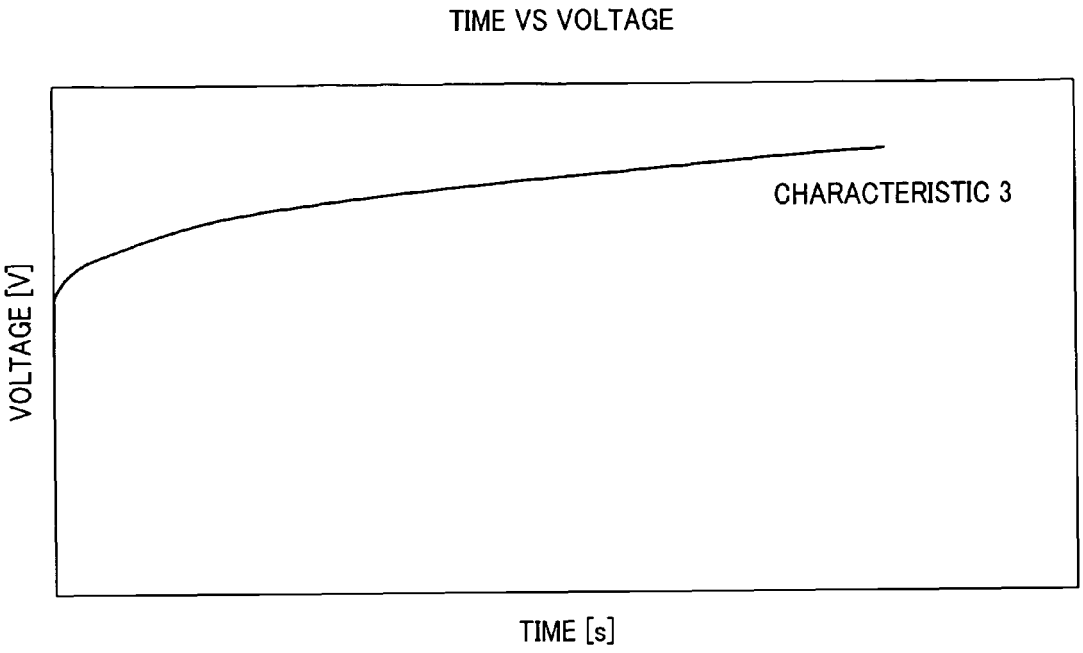
FIG. 12 is an example of temporal changes in voltage between terminals of the OLED elements.

FIG. 10 is an example in which the pixel structure shown in FIG. 9 is applied to the display device in FIG. 1. Although the screen is composed of plural pixels, only four pixels are displayed in FIG. 10. In FIG. 10, the display scanning circuit 200 is provided on the left side of the screen. Reset switch lines 52 and the lighting switch lines 53 extend from the display scanning circuit 200 to the respective pixels. The reset switch lines 52 are coupled to gates of the reset TFT switches 5 of the respective pixels. The lighting switch lines 53 are coupled to gates of the lighting TFT switches 2 of the respective pixels, so as to control whether or not the OLED element 1 is lit on.

The detection scanning circuit 150 is provided on the right side of the screen. The detection switch controlling lines TSCs extend from the detection scanning circuit 150 so as to control the detection switches 7. When the detection switches 7 are turned on, the voltage-current characteristics of the OLED element 1 can be detected. When the detection switches 7 are turned on, the lighting TFT switches 2 are turned off.

The signal driving circuit is provided on the upper side of the screen. The signal lines 54 extend from the signal driving circuit to the respective pixels. The R switches, G switches, or B switches configured by the signal line analog switches SSWs and MOSs are provided for the signal lines 54. The signal lines 54 are coupled to sources of the select switches 6 and sources of the detection switches 7 of the respective pixels.

The detection system 120 is provided on the right upper side of the screen. The detection system 120 is configured as described in FIG. 1. However, an anode of the OLED element 1 is coupled to the power source line 51 in the sixth embodiment, so that the direction of the constant current source 112 of the detection system 120 is opposite to those in FIG. 1 and the like. The detection line 116 extends from the detection system 120, and is branched so as to be coupled to the respective signal lines 54 in parallel. The branched detection lines 116 are coupled to the signal lines 54 via the detection line analog switch SWR1 and the like. When the signal line analog switch SSW is turned on, an image is displayed. When the detection line analog switch SWR1 and the like are turned on, the detection of the characteristics of the respective OLED elements 1 is performed.

All of the R switches, G switches and the like which are provided for the signal lines 54 and are MOS switches are usually turned on when image data is written into the respective pixels and an image is displayed. In the case where the OLED elements 1 are checked for each color when the detection of the characteristics of the OLED elements 1 is performed, the MOS switches corresponding to the pixels of the respective colors are turned on, and the other MOS switches are turned off.

As described above, according to the sixth embodiment, even in the pixel structure in which variations in the threshold voltage VTH of the OLED driving TFT3 are corrected, the detection of the characteristics of the OLED elements 1 can be effectively performed. Specifically, the detection switch 7 is provided between the cathode of the OLED element 1 and the lighting TFT switch 2, and the detection switch controlling lines TSCs extending from the detection scanning circuit 150 are coupled to the gates of the detection switches 7. Accordingly, the detection of the characteristics of the respective OLED elements 1 is controlled by a signal from the detection scanning circuit 150. In the above-described example, there has been described a case in which the pixel shown in FIG. 9 is applied to the display device in FIG. 1. However, it is obvious that the pixel configuration in FIG. 9 can be applied to not only the display device in FIG. 1, but also the display devices in FIGS. 3, 5, 6, and the like.

Figure 13B:
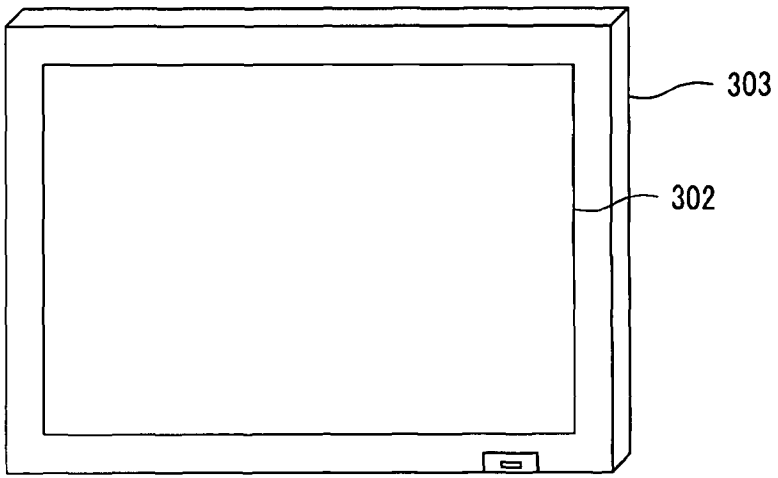
FIGS. 13A and 13B are examples of products in which the present invention is used.
Figure 13A:
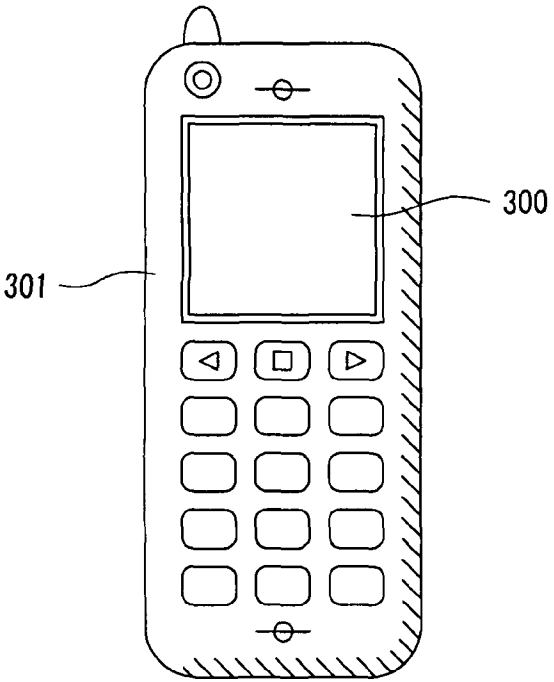

In FIG. 13A, an image display device 300 according to the present invention is used for an image display unit of a mobile electronic device 301, so that the characteristics of light-emitting elements that realize display can be rapidly detected by using a system with a low electric power.

In FIG. 13B, an image display device 302 according to the present invention is used for an image display unit of a television 303, so that the characteristics of light-emitting elements that realize display can be rapidly detected by using a system with a low electric power.

Figure 14B:
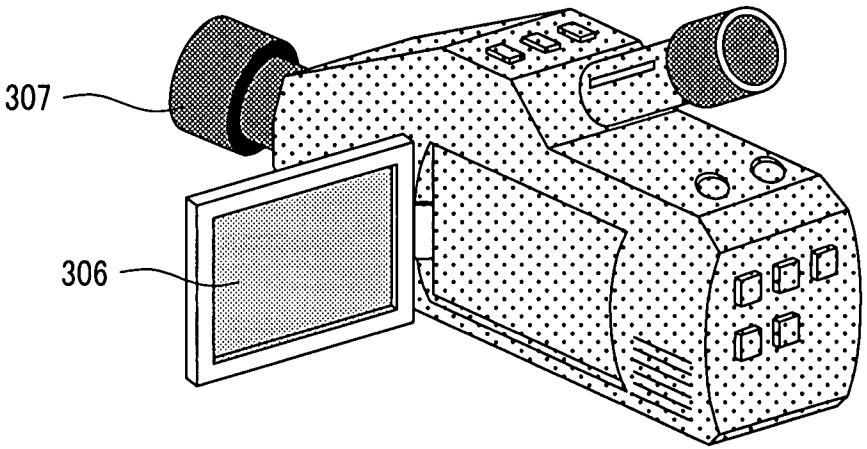
FIGS. 14A and 14B are other examples of products in which the present invention is used.
Figure 14A:
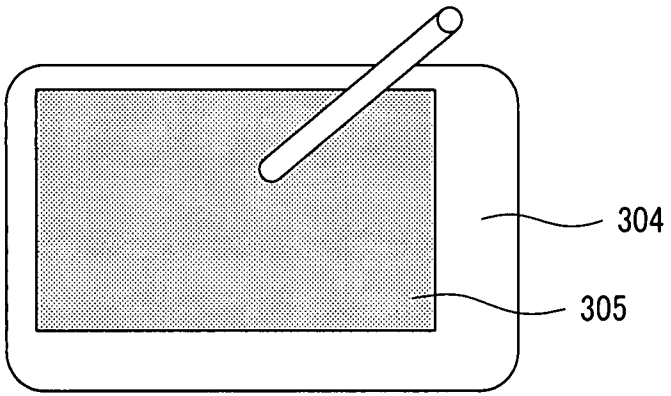

In FIG. 14A, an image display device 304 according to the present invention is used for an image display unit of a personal digital assistance PDA 305, so that the characteristics of light-emitting elements that realize display can be rapidly detected by using a system with a low electric power.

In FIG. 14B, an image display device 306 according to the present invention is used for an image display unit of a viewfinder 307 of a video camera CAM, so that the characteristics of light-emitting elements that realize display can be rapidly detected by using a system with a low electric power.

What is claimed is:

1. A display device in which a plurality of pixels, each having a light-emitting element that emits a red light, a green light, or a blue light, are formed in a matrix manner, the display device comprising:

at least n power source lines to supply power for the light emitting elements;

at least n signal lines for each color of light emitted by the light-emitting elements;

a signal driving circuit which supplies an image signal to the signal lines;

a display scanning circuit which supplies a signal for selecting pixels to which the image signal is transmitted;

m first scanning lines which extend from the display scanning circuit to intersect with the signal lines;

a display unit which includes the plurality of pixels coupled to the signal lines and the first scanning lines;

a detection circuit which measures the characteristics of the light-emitting elements of the red, green, or blue light-emitting elements of the respective pixels by flowing a constant current from the signal lines to the respective pixels;

a detection scanning circuit which supplies, a signal for selecting the pixels for which characteristics of the light-emitting elements of the pixels are measured; and m second scanning lines which extend from the detection scanning circuit to intersect with the signal lines, and wherein:

first switches coupled to the signal driving circuit and second switches coupled to the detection circuit are provided for the signal lines, a plurality of second switches coupled to the detection circuit are selected at the same time, a set of two or more and less than m×n of the pixels are selected by supplying, from the detection scanning circuit, a signal for selecting the set of the pixels for which characteristics of the light-emitting elements of the pixels are measured, a group of the pixels are detected at the same time to measure the characteristics of light-emitting elements of the red, green, or blue light-emitting elements of the respective pixels, a detection switch is provided for each pixel between the light-emitting element and the signal line for the pixel, and the detection switch for each pixel, is driven by the detection scanning circuit.

2. The display device according to claim 1, wherein the characteristics of the light-emitting elements of the pixels are voltage-current characteristics of the pixels.

3. The display device according to claim 1, wherein the group of the pixels detected at the same time are pixels which emit lights of the same color.

4. The display device according to claim 1, wherein the group of the pixels detected at the same time are pixels arranged on the same line among the pixels arranged in a matrix manner.

5. The display device according to claim 1, wherein the group of the pixels detected at the same time are pixels arranged on the same row among the pixels arranged in a matrix manner.

6. The display device according to claim 1, wherein the group of the pixels detected at the same time include pixels which emit lights of different colors.

7. The display device according to claim 1, wherein the light-emitting elements are organic light emitting diode (OLED) elements.

* * * * *